US009302399B2

(12) United States Patent
Kao

(10) Patent No.: US 9,302,399 B2
(45) Date of Patent: Apr. 5, 2016

(54) FOLDING KNIFE WITH SAFE PUSHING MECHANISM

(71) Applicant: Chih-Chen Kao, Taoyuan (TW)

(72) Inventor: Chih-Chen Kao, Taoyuan (TW)

( * ) Notice: Subject to any disclaimer, the term of this patent is extended or adjusted under 35 U.S.C. 154(b) by 121 days.

(21) Appl. No.: 14/271,936

(22) Filed: May 7, 2014

(65) Prior Publication Data

US 2015/0209967 A1 Jul. 30, 2015

(30) Foreign Application Priority Data

Jan. 27, 2014 (TW) ..... 103201679 U

(51) Int. Cl.
*B26B 1/04* (2006.01)

(52) U.S. Cl.
CPC ..... *B26B 1/044* (2013.01)

(58) Field of Classification Search
CPC ..... B26B 1/02; B26B 1/04; B26B 1/044
See application file for complete search history.

(56) References Cited

U.S. PATENT DOCUMENTS 6,651,344 B2 * 11/2003 Cheng ..... B26B 1/044 30/159
7,165,329 B2 * 1/2007 Kao ..... B26B 1/048 30/160
7,275,321 B2 * 10/2007 Cheng ..... B26B 1/046 30/158
7,600,322 B2 * 10/2009 Kao ..... B26B 1/042 30/151
7,886,444 B2 * 2/2011 Kao ..... B26B 1/044 30/159
8,020,302 B2 * 9/2011 Kao ..... B26B 1/02 30/155
8,375,589 B2 * 2/2013 Bremer ..... B26B 1/046 30/155
8,572,851 B2 * 11/2013 Duey ..... B26B 1/048 30/159
8,813,366 B2 * 8/2014 Chen ..... B26B 1/048 30/158
8,863,394 B2 * 10/2014 Lo ..... B26B 1/044 30/155
2008/0276463 A1 * 11/2008 Kao ..... B26B 1/046 30/155
2009/0217533 A1 * 9/2009 Kao ..... B26B 1/02 30/159
2015/0209967 A1 * 7/2015 Kao ..... B26B 1/044 30/159

* cited by examiner

*Primary Examiner* — Hwei C Payer
(74) *Attorney, Agent, or Firm* — Bacon & Thomas, PLLC

(57) ABSTRACT

The present invention is to provide a folding knife, which includes a handle provided therein with first and second slots, wherein the first slot extends slantingly from a first end toward a second end of the handle; a pushing element formed with a third slot slantingly extending in a direction opposite to the first slot and at least one post; and a pressing element having one end pivotally provided in the handle and another end provided with at least one sliding block capable of moving in the first and third slots and an abutting portion capable of abutting against the blade. When the pushing element is pushed, the post moves along the second slot and drives the sliding block to move along the first and third slots, thereby enabling the abutting portion to apply force to the blade and rotate the blade out of the handle to a predetermined angle.

13 Claims, 7 Drawing Sheets

FOLDING KNIFE WITH SAFE PUSHING MECHANISM

FIELD OF THE INVENTION

The present invention relates to a folding knife, more particularly to a folding knife having a safe pushing mechanism wherein, when a blade is pivotally and completely received in a handle of the knife, if a pushing element exposed outside the handle is pushed, a post of the pushing element moves along a second slot formed on the handle and drives a sliding block of a pressing element to simultaneously move along a first slot formed on the handle and a third slot formed on the pushing element, thereby enabling an abutting portion of the pressing element to apply a force to the blade and rotate the blade out of the handle to a predetermined angle. Since the first and third slots are slantingly extending cross each other, the sliding block of the pressing element is subjected to the friction of the inner wall surfaces of both the first and third slots, such that the user has to apply a relatively large force in order to move the pushing element, so as to effectively prevent the folding knife from being inadvertently opened by a child and causing injury or damage by accident.

BACKGROUND OF THE INVENTION

A commercially available folding knife is typically composed of a handle and a blade. One end of the blade is pivotally connected to one end of the handle so that the blade can be rotated about a pivot either out of the handle or into the handle for storage. When it is desired to use the folding knife, the handle is held in one hand, and the blade is pulled with the other hand in order to rotate the blade out of the handle. As the blade cannot be rotated out of the handle without using both hands, a user may have problem opening the knife in a special or emergency situation where only one hand is available. For example, a diver having one hand caught in a fish net may find it difficult to cut off the net immediately with the folding knife, which puts the diver's life in danger. To solve the problem, a folding knife with an elastic element was designed, allowing the user to rotate the blade out of the handle single-handedly, as explained in more detail in the following paragraphs.

Referring to FIG. 1A and FIG. 1B, the folding knife 1 includes a handle 11, a blade 12, an elastic element 13, and a pushing element 14. The blade 12, which has one end pivotally provided at one end of the handle 11, can be rotated about an axis defined by the pivotally connected portions of the blade 12 and the handle 11. More specifically, the blade 12 can be rotated out of the handle 11 for use (e.g., for cutting an object) or into the handle 11 for storage. In the latter case, the folding knife 1 is also reduced in volume and can be carried around conveniently, without fear that the blade 12 will cause human injury or damage. The elastic element 13 has one end fixedly provided in, and adjacent to, the other end of the handle 11. The other end (hereinafter referred to as the second end) of the elastic element 13 extends to a position adjacent to where the handle 11 and the blade 12 are pivotally connected. When the blade 12 is completely received in the handle 11 (as shown in FIG. 1A), the second end of the elastic element 13 abuts against the blade 12 at a position adjacent to where the handle 11 and the blade 12 are pivotally connected (e.g., against a post 121 provided on the blade 12, as shown in FIG. 1A and FIG. 1B), thereby generating a torque tending to rotate the blade 12 further into the handle 11 (as indicated by the arrow in FIG. 1A); as a result, the blade 12 is firmly received in the handle 11. Once the blade 12 is rotated out of the handle 11 to a predetermined angle, the elastic element 13 generates a torque tending to rotate the blade 12 further out of the handle 11 (as indicated by the arrow in FIG. 1B) such that the blade 12 spins out of the handle 11 automatically.

As shown in FIG. 1A and FIG. 1B, the pushing element 14 is pivotally connected to the handle 11 and the blade 12. As shown in FIG. 1A, the pushing element 14 is a plate-shaped element and has one end extending out of the handle 11 and protrudingly provided with a pushing portion 141 to be pushed by the user. Another end of the pushing element 14 is provided with a pressing portion 142. When the blade 12 is completely received in the handle 11, as shown in FIG. 1A, the pressing portion 142 abuts against the blade 12. If the user pushes the pushing portion 141 now, the pushing element 14 will be rotated and drive the pressing portion 142 to push the blade 12. Consequently, the blade 12 is rotated out of the handle 11 to the predetermined angle, and thanks to the torque generated by the elastic element 13 to rotate the blade 12 further out of the handle 11, the blade 12 spins out of the handle 11 automatically, as shown in FIG. 1B. Therefore, the user only has to hold the handle 11 firmly in one hand and push the pushing portion 141 gently with a finger, and the blade 12 will spring out of the handle 11 rapidly and smoothly, allowing the user to deal with the emergency at hand. As such, the convenience and safety of use of the folding knife 1 are effectively enhanced.

While the folding knife described above can be operated with only one hand, which is truly convenient, its operation can be extremely dangerous to children due to the fact that the pushing portion of the pushing element protrudes conspicuously from the handle. More specifically, anyone who has overcome the force applied by the elastic element to the blade (i.e., the post) can turn the pushing element and cause the blade to spin out of the handle. Hence, it has been an important issue in the folding knife industry to design a folding knife structure which retains the pushing element but somehow increases the difficulty with which the pushing element can be pushed, thereby preventing the blade from being easily rotated out of the handle by children.

BRIEF SUMMARY OF THE INVENTION

In view of the fact that the foregoing conventional folding knife may be inadvertently opened by children, the inventor of the present invention incorporated years of practical experience into extensive research and experiment and finally succeeded in developing a folding knife with a safe pushing mechanism. The folding knife disclosed herein is safer than its prior art counterparts.

It is an objective of the present invention to provide a folding knife having a safe pushing mechanism, wherein the folding knife includes a handle, a blade, a pressing element, and a pushing element. The handle is provided therein with a first slot and a second slot, both of which slots are adjacent to one end of the handle (hereinafter referred to as the first end of the handle). The first slot has a first end adjacent to the first end of the handle and an opposite second end extending slantingly toward the other end of the handle (hereinafter referred to as the second end of the handle). The second slot has a first end adjacent to the second end of the first slot and an opposite second end extending toward the second end of the handle. The blade has one end pivotally connected in the handle and adjacent to the first end of the handle so that the blade can be rotated out of or into the handle about the position where the handle and the blade are pivotally connected. The pressing element has one end pivotally provided in the handle and adjacent to the position where the handle and the blade are pivotally connected. Another end of the pressing element is provided with at least one sliding block and an abutting portion. The sliding block extends into and can be displaced in the first slot. When the blade is completely received in the handle, the abutting portion abuts against the blade, and the sliding block is located at the first end of the first slot. The pushing element is provided in the handle and adjacent to the position where the handle and the blade are pivotally connected. The pushing element has a side exposed from the handle and is formed with a third slot and at least one post. The third slot has a first end adjacent to the first end of the handle and an opposite second end extending slantingly toward the second end of the handle. Moreover, the extending direction of the third slot crosses the extending direction of the first slot. The sliding block of the pressing element extends into and can be displaced in the third slot. The post extends into and can be displaced in the second slot. When the blade is completely received in the handle, the sliding block is located at the second end of the third slot, and the post is adjacent to the first end of the second slot. Once the exposed side of the pushing element is pushed and displaced toward the second end of the handle, the post is displaced from the first end of the second slot toward the second end of the second slot, thereby driving the sliding block of the pressing element to displace. More specifically, the sliding block is displaced simultaneously from the second end of the third slot toward the first end of the third slot and from the first end of the first slot toward the second end of the first slot. As a result, the abutting portion of the pressing element applies a force to the blade, causing the blade to rotate out of the handle to a predetermined angle. When being displaced in the first slot and the third slot, whose extending directions cross each other, the sliding block of the pressing element is subjected to the friction of the inner wall surfaces of both the first slot and the third slot; that is to say, the user has to apply a relatively large force in order to move the pushing element. Thus, the pushing element is prevented from being inadvertently pushed by a child, and the blade from spinning out and causing injury or damage by accident.

Another objective of the present invention is to provide the foregoing folding knife, wherein the folding knife is further provided with an elastic element. The elastic element has one end positioned in the handle and adjacent to the second end of the handle and an opposite end extending to a position in the handle that is adjacent to the position where the handle and the blade are pivotally connected. When the blade is completely received in the handle, the elastic element generates a torque tending to rotate the blade further into the handle. Once the blade is rotated out of the handle to a predetermined angle, the elastic element generates a torque tending to rotate the blade further out of the handle. Therefore, after the user pushes the pushing element, causing the pressing element to rotate the blade out of the handle to the predetermined angle, the blade spins out of the handle automatically due to the torque generated by the elastic element to rotate the blade further out of the handle. Thus, single-handed operation of the folding knife is achieved.

BRIEF DESCRIPTION OF THE SEVERAL VIEWS OF THE DRAWINGS

The objectives, as well as the technical features and their effects, of the present invention will be best understood by referring to the following detailed description of some illustrative embodiments in conjunction with the accompanying drawings, in which.

DETAILED DESCRIPTION OF THE INVENTION

Figure 1A:
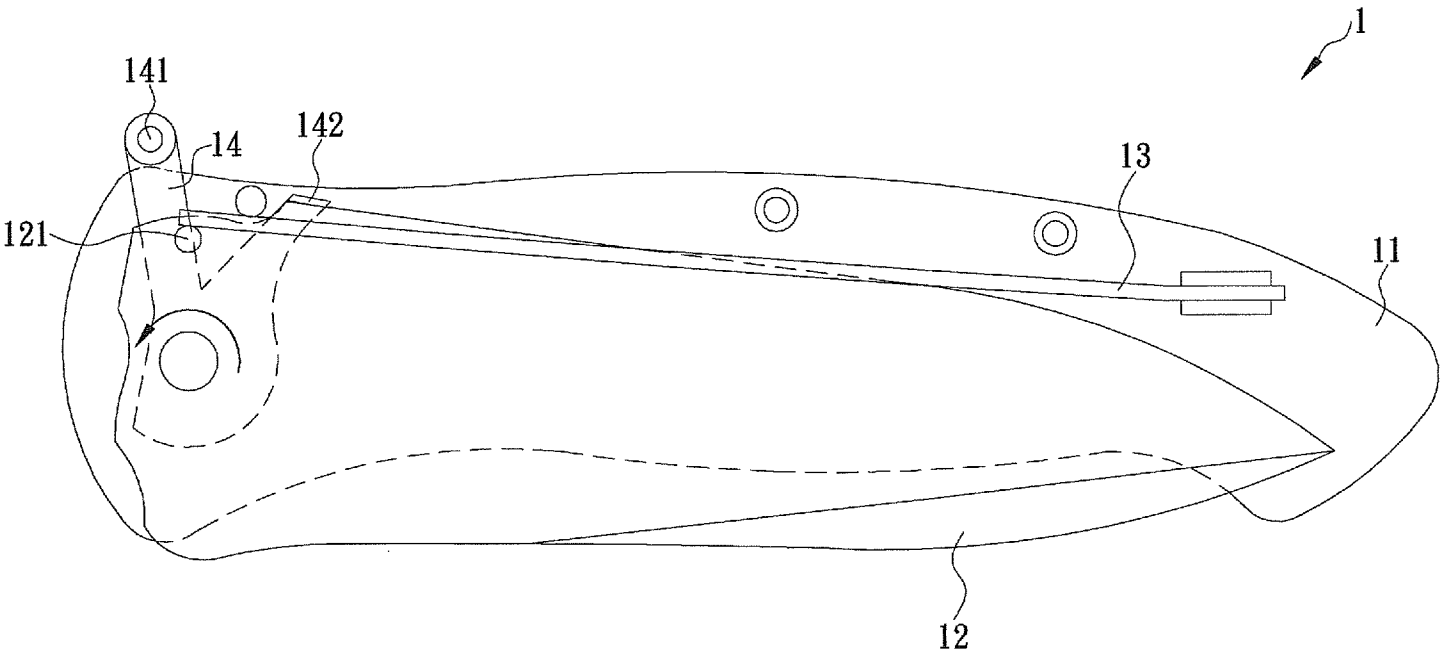
FIG. 1A (Prior Art)
FIG. 1A is a schematic drawing of a conventional folding knife.
Figure 1B:
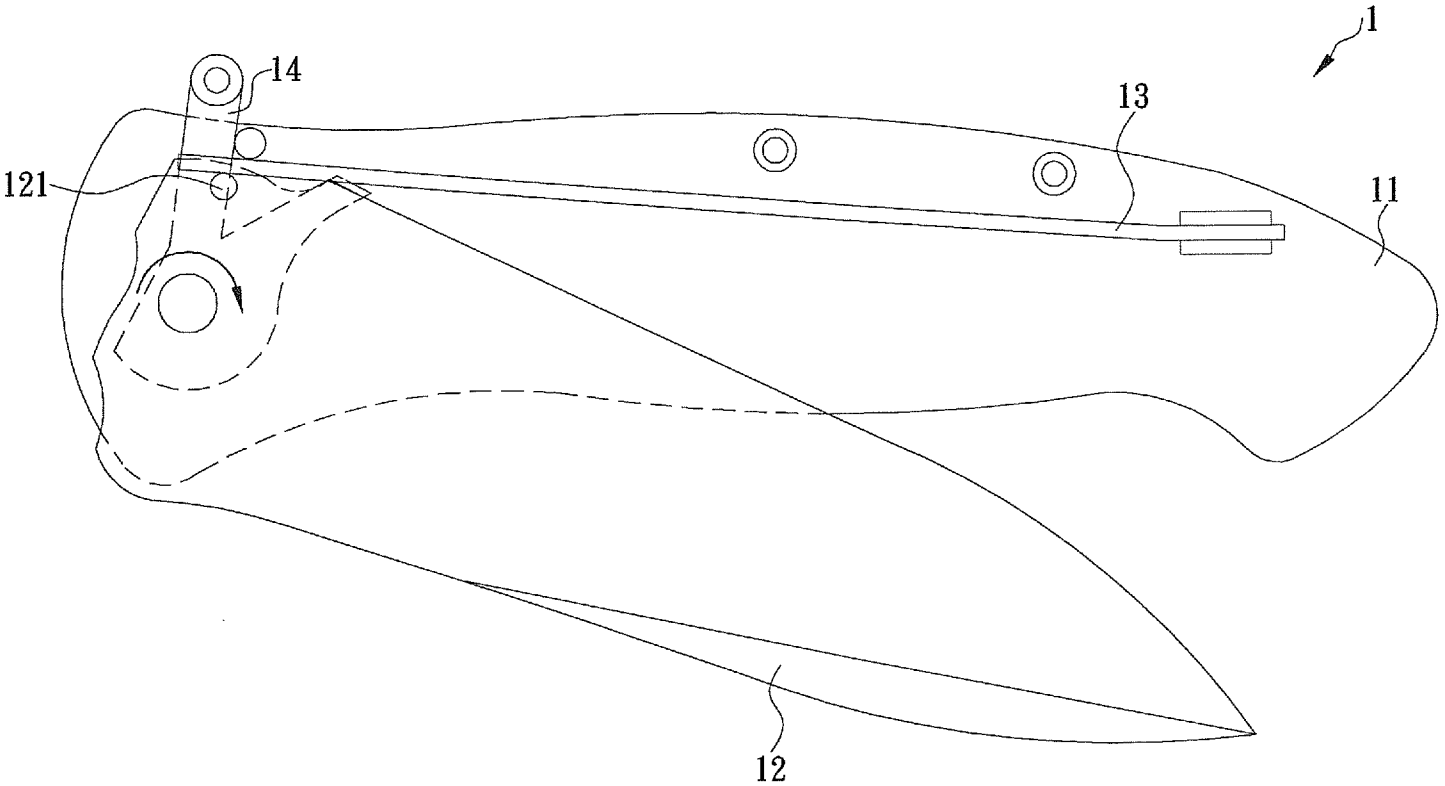
FIG. 1B (Prior Art)
FIG. 1B is another schematic drawing of the conventional folding knife shown in FIG. 1A.
Figure 2:
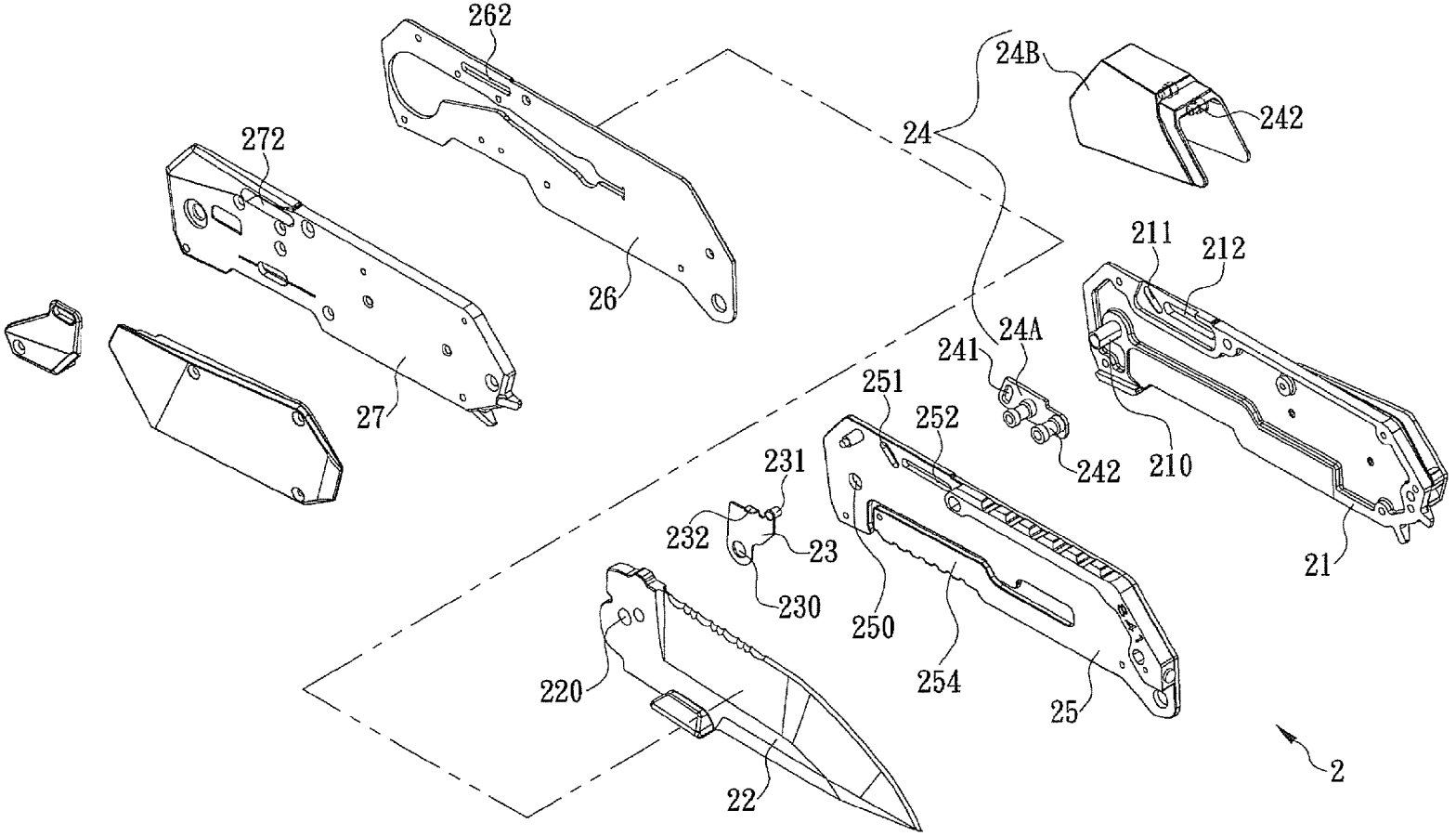
FIG. 2 is an exploded perspective view of the folding knife in an embodiment of the present invention.

The present invention discloses a folding knife with a safe pushing mechanism. In one embodiment of the present invention as shown in FIG. 2, the folding knife 2 includes a handle 21, a blade 22, a pressing element 23, a pushing element 24, a first plate 25, a second plate 26, and a cover 27. It should be pointed out that only the handle 21, the blade 22, the pressing element 23, and the pushing element 24 are essential components of the folding knife 2 of the present invention and are crucial to the realization of the intended effects of the following embodiments. The remaining of the aforesaid components may be dispensed with, or other components may be added, according to design requirements. Therefore, the folding knife of the present invention is by no means limited to the embodiments disclosed herein. For the sake of clarity, FIG. 3A to FIG. 4B show only the essential components.

Referring to FIG. 2, the handle 21 is provided therein with a first slot 211 and a second slot 212, both of which slots are adjacent to one end of the handle 21 (hereinafter referred to as the first end of the handle). The first slot 211 has a first end adjacent to the first end of the handle 21 and an opposite second end extending slantingly toward the other end of the handle 21 (hereinafter referred to as the second end of the handle). The second slot 212 has a first end adjacent to the second end of the first slot 211 and an opposite second extending toward the second end of the handle 21. The blade 22 has one end pivotally connected in the handle 21 at a position adjacent to the first end of the handle 21. The blade 22 can be rotated, about the location where it is pivotally connected to the handle 21, either out of or into the handle 21. In this embodiment, the first end of the handle 21 is provided with a pivot pin 210, and the aforesaid end of the blade 22 is provided with a pivot hole 220. The pivot pin 210 of the handle 21 extends into the pivot hole 220 of the blade 22 to pivotally connect the handle 21 and the blade 22 as a single unit.

Figure 3A:
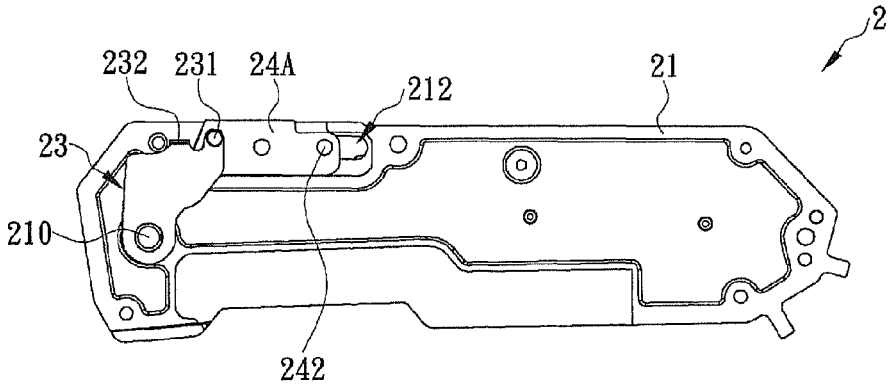
FIG. 3A shows one position of the sliding block of the present invention.
Figure 3B:
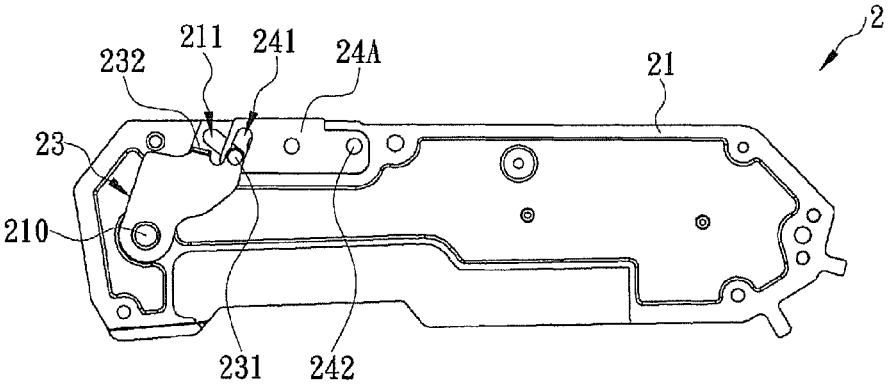
FIG. 3B shows another position of the sliding block of the present invention.
Figure 4A:
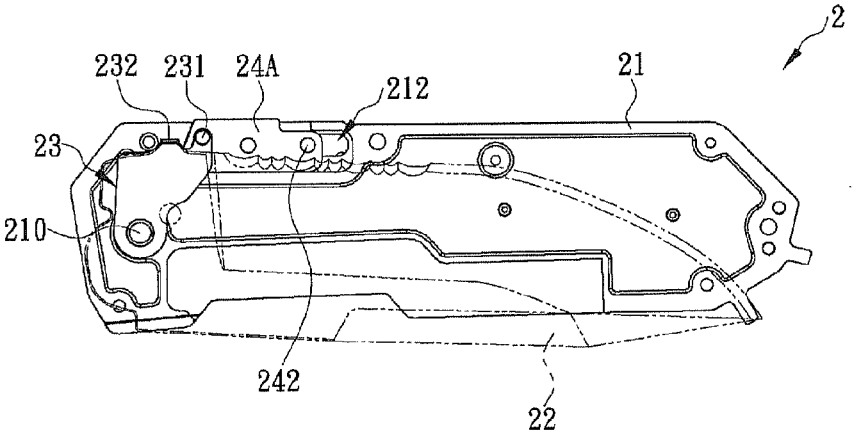
FIG. 4A shows one state of the folding knife of the present invention.

With continued reference to FIG. 2, the pressing element 23 has a first end pivotally provided in the handle 21 at a position adjacent to the position where the handle 21 and the blade 22 are pivotally connected. The pressing element 23 further has a second end provided with at least one sliding block 231 and an abutting portion 232. Referring to FIG. 3A and FIG. 3B, the sliding block 231 extends into the first slot 211 and can be displaced in the first slot 211. When the blade 22 is completely received in the handle 21, the abutting portion 232 abuts against the blade 22, and the sliding block 231 is located at the first end of the first slot 211 (as shown in FIG. 4A). The pushing element 24 is provided in the handle 21 at a position adjacent to the position where the handle 21 and the blade 22 are pivotally connected. The pushing element 24 has a side exposed from the handle 21 and is formed with a third slot 241 and at least one post 242. The third slot 241 has a first end adjacent to the first end of the handle 21 and an opposite second end extending slantingly toward the second end of the handle 21. Moreover, the extending direction of the third slot 241 crosses the extending direction of the first slot 211. In this embodiment, the pushing element 24 is composed of a first member 24A and a second member 24B connected together, each of which members is provided with at least one post 242. Once the first member 24A and the second member 24B are put together, the post 242 of the second member 24B is engaged in the first member 24A such that the two members form a single unit. In other embodiments of the present invention, however, the pushing element 24 may be a single component or an assembly of more than two components.

Referring to FIG. 2 to FIG. 3B, the sliding block 231 of the pressing element 23 extends into the third slot 241 and can be displaced in the third slot 241. The posts 242 extend into the second slot 212 and can be displaced in the second slot 212. When the blade 22 is completely received in the handle 21, the sliding block 231 is located at the second end of the third slot 241, and the posts 242 are adjacent to the first end of the second slot 212 (as shown in FIG. 4A). In this embodiment, the first plate 25 is provided between the pressing element 23 and the pushing element 24 (i.e., the first member 24A). The pressing element 23 and the first plate 25 are respectively provided with pivot holes 230 and 250 through which the pivot pin 210 extends to connect the pressing element 23 and the first plate 25 to the handle 21. In order for the sliding block 231 and the posts 242 to extend into the first slot 211 and the second slot 212 respectively, the first plate 25 is formed with a fourth slot 251 and a fifth slot 252. The fourth slot 251 and the fifth slot 252 have the same configurations as the first slot 211 and the second slot 212 respectively, but in other embodiments of the present invention the shape of the first plate 25 may be adjusted so that the fourth slot 251 and the fifth slot 252 are dispensed with. Moreover in this embodiment, the first plate 25 is provided with a stop portion 254. After the blade 22 is rotated out of the handle 21, the stop portion 254 abuts against the aforesaid end of the blade 22 to fix the blade 22 in position. Thus, the blade 22 is prevented from suddenly rotating back into the handle 21 when in use.

Figure 4B:
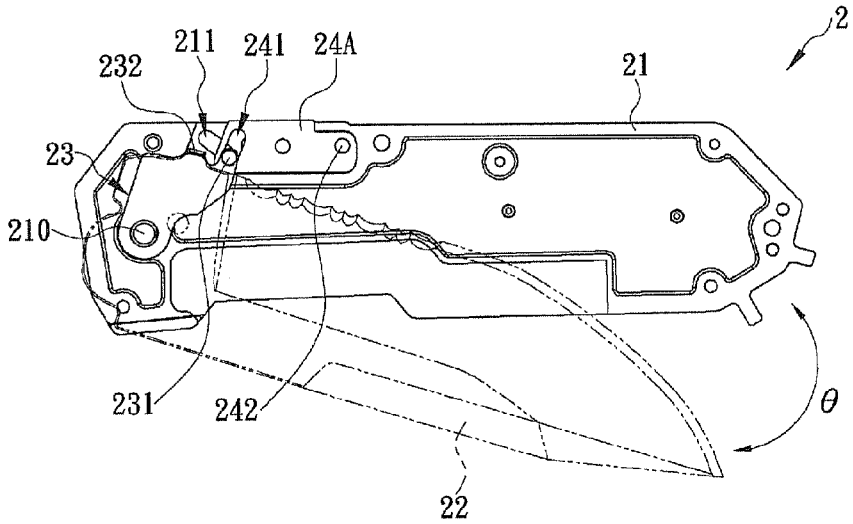
FIG. 4B shows another state of the folding knife of the present invention.
Figure 5:
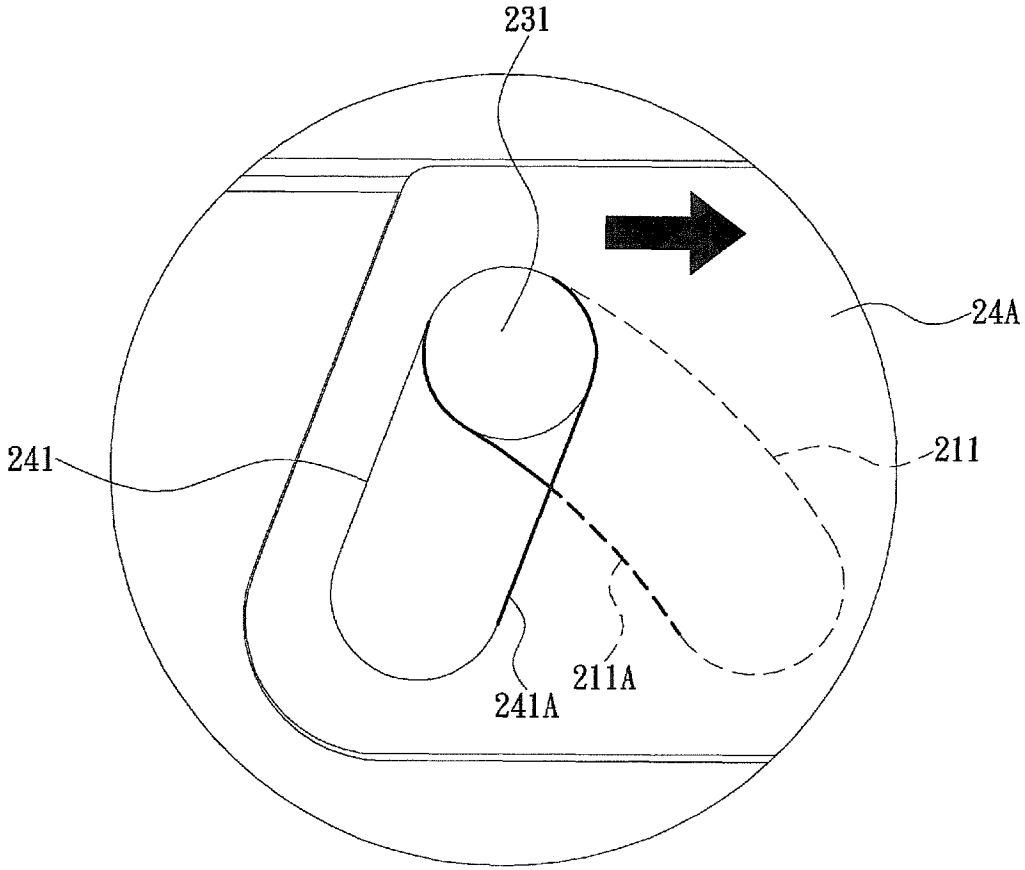
FIG. 5 is a partial enlarged view showing the sliding block, the first slot, and the third slot of the present invention.

Referring to FIG. 2 to FIG. 4B, when the exposed side of the pushing element 24 is pushed (i.e., when the second member 24B is pushed) and displaced toward the second end of the handle 21, the posts 242 are displaced from the first end of the second slot 212 toward the second end of the second slot 212, thereby displacing the sliding block 231 of the pressing element 23. More specifically, the sliding block 231 is displaced simultaneously from the second end of the third slot 241 toward the first end of the third slot 241 and from the first end of the first slot 211 toward the second end of the first slot 211. Along the direction in which the sliding block 231 of the pressing element 23 is displaced, the abutting portion 232 of the pressing element 23 applies a force to the blade 22 and thereby rotates the blade 22 out of the handle 21 to a predetermined angle θ (as shown in FIG. 4B), allowing the user to grasp the exposed portion of the blade 22 and rotate the blade 22 completely out of the handle 21. In addition, referring to FIG. 5, since the extending directions of the first slot 211 and the third slot 241 cross each other, the sliding block 231 when forced (i.e., when the first member 24A of the pushing element 24 is displaced in the direction indicated by the arrow in FIG. 5) to displace in the first slot 211 and the third slot 241 is subjected to the friction of both the inner wall surface 211A of the first slot 211 and the inner wall surface 241A of the third slot 241. In other words, the user has to apply a relatively large force in order to move the pushing element 24 and displace the sliding block 231 in the first slot 211 and the third slot 241. For a child who is unable to apply such a large force, therefore, it will be difficult to move the pushing element 24. The blade 22 is thus kept from spinning out and causing injury should such a child play with the folding knife.

Figure 6:
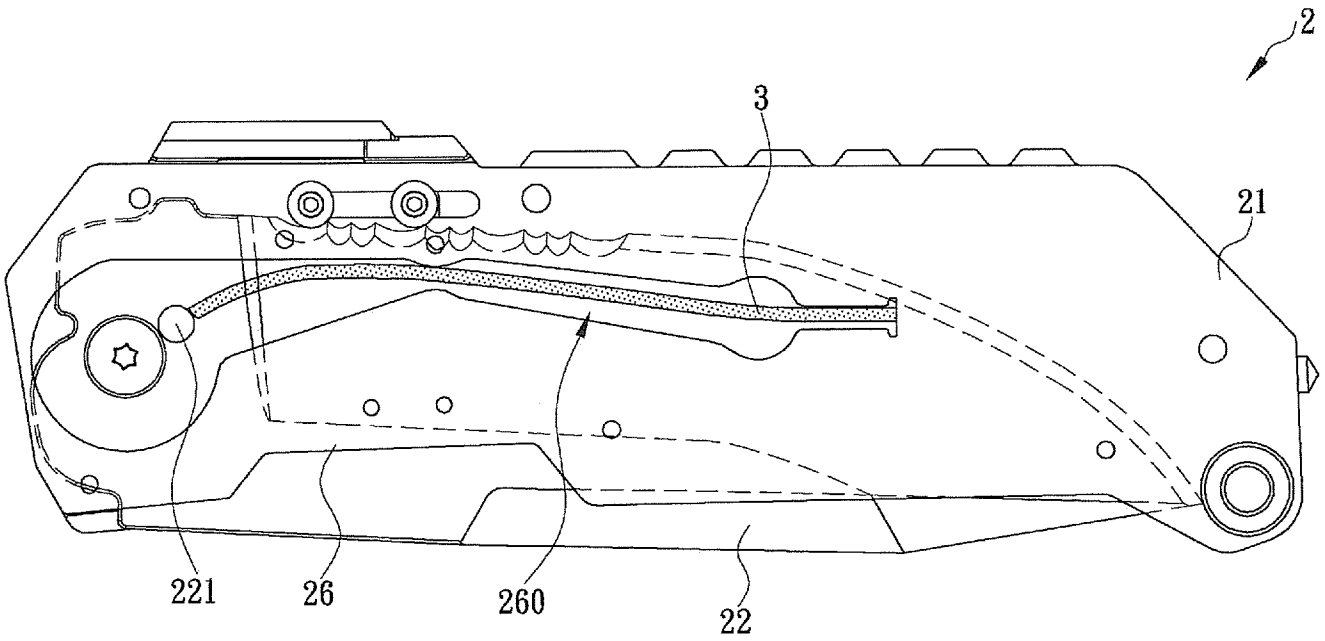
FIG. 6 shows another embodiment of the present invention.

In this embodiment, referring back to FIG. 2, the second plate 26 and the cover 27 are sequentially connected to the handle 21 to cover the blade 22. The second plate 26 and the cover 27 are respectively provided with a sixth slot 262 and a seventh slot 272, both of which slots have the same configuration as the second slot 212 to facilitate insertion by the posts 242. In other embodiments of the present invention, however, the second plate 26 and the cover 27 may be adjusted in shape so that the sixth slot 262 and the seventh slot 272 are omitted. It is also feasible to dispense with the second plate 26. In order to enable single-handed operation of the folding knife 2, the folding knife 2 in an alternative embodiment is additionally provided with an elastic element 3, as shown in FIG. 6. Please note that the embodiment in FIG. 6 uses the same reference numerals for the same components as those in the previous embodiment. The elastic element 3 is imbedded in an open groove 260 of the second plate 26. The elastic element 3 has one end positioned in the handle 21 and adjacent to the second end of the handle 21 and an opposite second end extending to a position in the handle 21 that is adjacent to the position where the handle 21 and the blade 22 are pivotally connected. When the blade 22 is completely received in the handle 21, the elastic element 3 abuts against a bump 221 on the blade 22 and generates a torque tending to rotate the blade 22 further into the handle 21; consequently, the blade 22 is kept in the handle 21. Once the blade 22 is forced to rotate out of the handle 21 to the predetermined angle θ (as shown in FIG. 4B), the elastic element 3 generates a torque tending to rotate the blade 22 further out of the handle 21, and the blade 22 springs out of the handle 21 automatically. As such, the folding knife 2 can be operated single-handedly.

While the invention herein disclosed has been described by means of specific embodiments, numerous modifications and variations could be made thereto by those skilled in the art without departing from the scope of the invention set forth in the claims.

What is claimed is:

1. A folding knife with a safe pushing mechanism, comprising:

a handle provided therein with a first slot and a second slot, both said slots being adjacent to a first end of the handle, the first slot having a first end adjacent to the first end of the handle and a second end extending slantingly toward a second end of the handle, the second slot having a first end adjacent to the second end of the first slot and a second end extending toward the second end of the handle;

a blade having an end pivotally connected in the handle at a position adjacent to the first end of the handle, the blade being rotatable out of or into the handle about a position where the handle and the blade are pivotally connected;

a pressing element having a first end pivotally provided in the handle at a position adjacent to the position where the handle and the blade are pivotally connected, the pressing element having a second end provided with at least one sliding block and an abutting portion, the sliding block extending into and being displaceable in the first slot, wherein when the blade is completely received in the handle, the abutting portion abuts against the blade, and the sliding block is located at the first end of the first slot; and a pushing element provided in the handle at a position adjacent to the position position where the handle and the blade are pivotally connected, the pushing element element having a side exposed from the handle, the pushing element being formed with a third slot and at least one post, the third slot having a first end adjacent to the first end of the handle and a second end extending slantingly toward the second end of the handle, the third slot having an extending direction crossing an extending direction of the first slot, the sliding block of the pressing element extending into and being displaceable in the third slot, the post extending into and being displaceable in the second slot, wherein when the blade is completely received in the handle, the sliding block is located at the second end of the third slot, and the post is located adjacent to the first end of the second slot;

wherein when the side of the pushing element is pushed and displaced toward the second end of the handle, the post is displaced from the first end of the second slot toward the second end of the second slot and drives the sliding block of the pressing element such that the sliding block is displaced simultaneously from the second end of the third slot toward the first end of the third slot and from the first end of the first slot toward the second end of the first slot, causing the abutting portion of the pressing element to apply a force to the blade, thereby rotating the blade out of the handle to a predetermined angle.

2. The folding knife of claim 1, further comprising an elastic element, wherein: the elastic element has an end positioned in the handle and adjacent to the second end of the handle and a second end extending to a position in the handle that is adjacent to the position where the handle and the blade are pivotally connected; when the blade is completely received in the handle, the elastic element generates a torque tending to rotate the blade further into the handle; and when the blade has been rotated out of the handle to the predetermined angle, the elastic element generates a torque tending to rotate the blade further out of the handle.

3. The folding knife of claim 2, further comprising a first plate between the pressing element and the pushing element, the first plate being provided with a stop portion, the stop portion abutting against the end of the blade when the blade has been rotated completely out of the handle.

4. The folding knife of claim 3, wherein the first plate is formed with a fourth slot and a fifth slot, the fourth slot having a same configuration as the first slot so as for the sliding block to extend into the fourth slot as well as the first slot, the fifth slot having a same configuration as the second slot so as for the post to extend into the fifth slot as well as the second slot.

5. The folding knife of claim 4, further comprising a second plate formed with an open groove, the elastic element being imbedded in the second plate and received in the open groove.

6. The folding knife of claim 5, wherein the second plate is formed with a sixth slot, the sixth slot having a same configuration as the second slot so as for the post to extend into the sixth slot as well as the second slot.

7. The folding knife of claim 6, further comprising a cover, the cover being connected to the handle and covering the blade.

8. The folding knife of claim 7, wherein the cover is formed with a seventh slot, the seventh slot having the same configuration as the second slot so as for the post to extend into the seventh slot as well as the second slot.

9. The folding knife of claim 8, wherein the blade is provided with a bump, and the elastic element abuts against the bump when the blade is completely received in the handle.

10. The folding knife of claim 2, wherein the pushing element is composed of a first member and a second member connected to each other.

11. The folding knife of claim 1, further comprising a first plate between the pressing element and the pushing element, the first plate being provided with a stop portion, the stop portion abutting against the end of the blade when the blade has been rotated completely out of the handle.

12. The folding knife of claim 11, wherein the first plate is formed with a a fourth slot and a fifth slot, the fourth slot having a same configuration as the first slot so as for the sliding block to extend into the fourth slot as well as the first slot, the the fifth slot having a same configuration as the second slot so as for the post to extend into the fifth slot as well as the second slot.

13. The folding knife of claim 1, wherein the pushing element is composed of a first member and a second member connected to each other.

* * * * *